US006644213B2

(12) United States Patent
Muth

(10) Patent No.: US 6,644,213 B2
(45) **Date of Patent: *Nov. 11, 2003**

(54) MOBILE CARRIAGE

(75) Inventor: James C. Muth, Oconomowoc, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/116,377

(22) Filed: Apr. 4, 2002

(65) Prior Publication Data

US 2002/0104458 A1 Aug. 8, 2002

Related U.S. Application Data

(62) Division of application No. 09/717,765, filed on Nov. 21, 2000, now Pat. No. 6,371,031, which is a division of application No. 09/101,066, filed as application No. PCT/US96/17422 on Oct. 30, 1996, now Pat. No. 6,161,485.

(51) Int. Cl.[7] ..... B61C 9/00

(52) U.S. Cl. ..... 105/96; 105/101; 105/133; 105/163.2; 105/157.1; 104/242; 104/245; 104/248

(58) Field of Search ..... 105/96, 98, 157.1, 105/101, 102, 104, 110, 112, 115, 122, 133, 163.2, 163.1; 104/288, 242, 245, 247, 287; 312/198, 201

(56) References Cited

U.S. PATENT DOCUMENTS

| | | | | |
|---|---|---|---|---|
| 1,858,929 A | | 5/1932 | Harry | |
| 2,294,999 A | | 9/1942 | Mitchell | |
| 2,509,384 A | | 5/1950 | Workman | |
| 2,556,603 A | | 6/1951 | Nelson | |
| 3,640,595 A | | 2/1972 | Staller et al. | |
| 4,017,131 A | * | 4/1977 | Camenisch | 312/198 |
| 4,417,524 A | | 11/1983 | Quinn et al. | |
| 5,007,351 A | | 4/1991 | Muth | |
| 5,024,164 A | | 6/1991 | Leist | |
| 5,569,910 A | | 10/1996 | Griesemer | |
| 6,112,917 A | | 9/2000 | Baker et al. | |

OTHER PUBLICATIONS

Affadavit of Douglas Mittag with attachments dated Aug. 21, 2002, 8 pages (including Equipto carriage prior to 1994).

* cited by examiner

*Primary Examiner*—Mark T. Le
(74) *Attorney, Agent, or Firm*—Boyle, Fredrickson, Newholm, Stein & Gratz, S.C.

(57) ABSTRACT

A mobile carriage system includes a pair of spaced, parallel end rails fixed to a support surface, often with one or more intermediate rails fixed to the support surface and located parallel to and between the pair of end rails. At least one carriage is supported for movement on the end and intermediate rails. The carriage includes an elongated frame that spans all of the rails. At least two drive units, each including a pair of wheels and supporting the carriage on a different one of the rails are provided. The drive units are operatively connected to a drive shaft which extends across a plurality of the rails. The drive shaft and each of the drive units are coupled by a drive gear on the shaft which has a first effective diameter and a driven gear on the drive unit, which has a second effective diameter substantially greater than the first effective diameter. Thus, the drive units minimize torsion twisting of the drive shaft during use. A source of rotational power such as an electric motor is operatively connected to the drive shaft.

28 Claims, 4 Drawing Sheets

MOBILE CARRIAGE

CROSS-REFERENCE TO RELATED APPLICATION

This application is a divisional of application Ser. No. 09/717,765, filed Nov. 21, 2000, now U.S. Pat. No. 6,371,031, which is a divisional of application Ser. No. 09/101,066, filed Jun. 29, 1998, now U.S. Pat. No. 6,161,485 issued Dec. 19, 2000, which is a 371 of PCT/US96/17422, filed Oct. 30, 1996.

BACKGROUND OF THE INVENTION

This invention pertains to power transmission, and more particularly to apparatus for driving mobile storage carriages.

Mobile storage systems, for storing books, supplies, and files are in widespread use where it is important to provide high density storage, such as in offices, schools, and libraries. My U.S. Pat. No. 5,007,351 describes an improved power transmission mechanism for use in such systems.

Typical mobile storage systems include two or more parallel rails embedded in or attached to a building floor. One or more relatively long and narrow carriages span the rails. The carriages may exceed eighty feet in length, and the number and spacing of the rails are chosen to suit the particular carriage length. The carriages are usually supported by a pair of wheels rolling along each of the rails.

The carriages may be designed to move along the rails under manual power. For that purpose, a hand wheel is usually mounted to a carriage end panel. The hand wheel is connected by various drive components to a shaft that in turn is connected with at least one of the carriage wheels. Manually rotating the hand wheel causes the drive wheels to rotate and move the carriage. Electrically powered carriages are also in wide-spread use. With that design, a suitable electric motor is substituted for the manual hand wheel. The motor shaft is mechanically connected through a suitable mechanism to the carriage drive wheels.

It has been a common practice to design mobile carriages such that drive wheels are located along the length of the carriage on one side of the carriage. These prior designs require a long shaft for connecting the drive wheels along the carriage length. The long shafts are awkward to assemble and service. In addition, the long shafts generally undergo torsional wind-up when used with heavy carriages, such that, due to twisting of the shaft along its length, the drive wheels at the carriage end remote from the electric motor or hand wheel do not rotate as fast as the drive wheels at the end at which the shaft is rotationally driven. Consequently, despite the use of flanges on the drive wheels, the carriages can tend to skew as they are driven along the rails.

In accordance with my earlier patent, a single driving mechanism was provided at the center of the carriage. However, a need has continued to exist for improved mobile storage carriages with more than one drive mechanism, but which would overcome the aforementioned skewing problem encountered with the prior art.

SUMMARY OF THE INVENTION

In accordance with the present invention, drive systems are provided which improve the performance of mobile storage system carriages and which obviate the aforementioned skewing problem.

In accordance with the invention, at least two synchronized transversely spaced drive units each engage separate rails. A single power source such as an electric motor is connected to a drive shaft that spans all of the rails on which drive units are provided. The shaft is provided with drive sprockets which are intermeshed with driven gears of the drive mechanisms. Torsional twisting of the drive shaft is minimized by use of gear ratios between these gears which provide a sufficient mechanical advantage to effectively reduce the torque applied to the drive shaft.

As in the case of my earlier invention, the drive wheels may have central flanges that fit within and are guided by a longitudinal groove in the rail top surface. Alternatively, the wheels may be flat or may be provided with flanges on each side and are adapted to travel on a flat rail. Anti-tip restraining clips may be provided to insure stability of the mobile storage system.

To drive the carriage drive wheels of each drive unit in synchronization, sprockets are provided to which power is transferred by means of a chain trained around the sprockets. The chain is driven by a drive sprocket that is attached to the drive shaft, which is in turn rotated by a power source such as an electric motor or the output shaft of a speed reducer. To provide tension adjustment to the drive chain, the drive sprocket or a separate idler sprocket is preferably made adjustable. The drive units of the present invention may also be driven by manually powered mechanisms.

Briefly, a mobile carriage system of this invention includes a pair of spaced, parallel end rails fixed to a support surface, and, usually, dependent on the length of the carriage, at least one or more intermediate rails fixed to the support surface and located parallel to and between the pair of end rails. At least one carriage is supported for movement on the end and any intermediate rails. The carriage includes an elongated frame that spans all of the rails. At least two drive units, each including a pair of wheels and supporting the carriage on a different one of the rails are provided. The drive units are operatively connected to a drive shaft which extends across a plurality of the rails. The drive shaft and each of the drive units are coupled by a drive gear on the shaft which has a first effective diameter and a driven gear on the drive unit, which has a second effective diameter substantially greater than the first effective diameter. Thus, the drive units minimize torsional twisting of the drive shaft during use. A source of rotational power such as an electric motor is operatively connected to the drive shaft.

Other features of the present invention will become apparent from the claims, detailed description and accompanying drawings.

DETAILED DESCRIPTION

Figure 1:
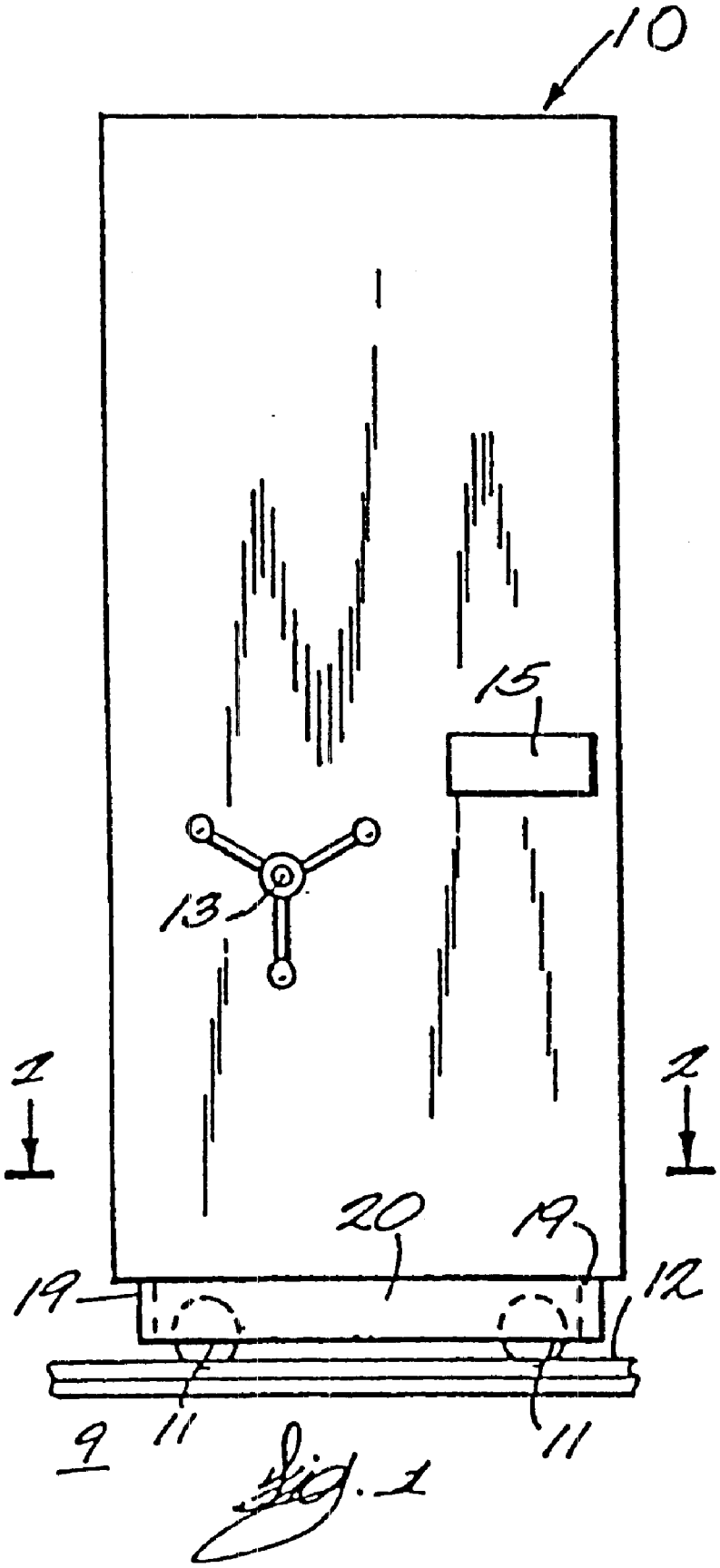
FIG. 1 is a simplified side view of a mobile storage carriage that employs the present invention.

Referring to FIG. 1, a mobile storage carriage 10 is illustrated that includes the present invention. The mobile carriage 10 is typically part of a mobile storage system that includes additional mobile carriages, as well as one or more stationary storage units (not shown), as are known in the art.

The mobile carriage 10 travels along two or more parallel rails 12 spaced longitudinally along the carriage length and embedded in or attached to a building floor 9. The carriage is supported on the rails 12 by respective pairs of wheels 11. Power for moving the carriage along the rails may be supplied manually. In that case, the ends of the carriage are usually furnished with a hand wheel 13. Alternately, the carriage may be designed with an electrically powered system. In that situation, the hand wheel 13 is eliminated, and a suitable electrical control, schematically represented at reference numeral 15, is substituted.

Figure 2:
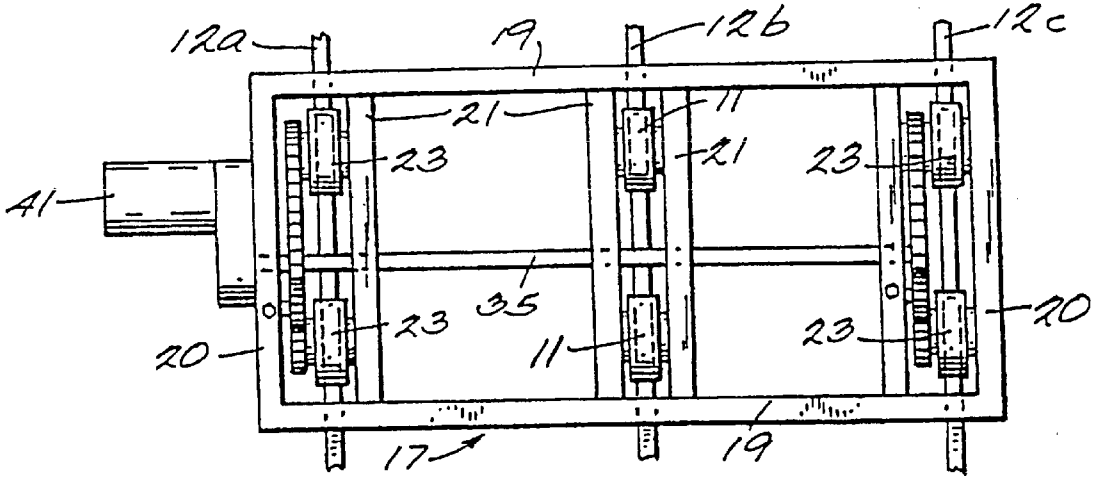
FIG. 2 is a cross sectional view taken along lines 2—2 of FIG. 1 and rotated 90° counterclockwise.

In accordance with the present invention, electrically and manually powered mobile carriages are driven along at least two of the rails 12*a* and 12*c* by synchronized pairs of wheels wherein each pair engages a rail. Looking also at FIG. 2, a mobile storage system is depicted that has three rails 12*a*, 12*b* and 12*c*. The frame 17 of a carriage 10 is designed with longitudinal beams 19 and with end members 20 at opposite ends and a cross brace structural member 21 adjacent to each of the rails. At least two wheels 11 are suitably journaled in each cross brace 21 for supporting the carriage on each associated rail which is not provided with drive wheels. The mounting of the wheels to the cross braces may be by conventional components that do not form a part of the present invention.

Figure 4:
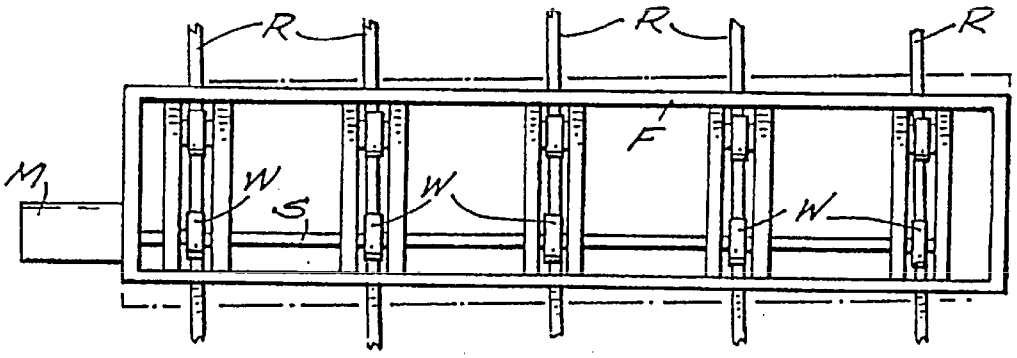
Fig. 4 PRIOR ART
FIG. 4 is a view similar to those of FIGS. 2 and 3 showing a prior art device.

The present invention overcomes the skewing problem illustrated in FIG. 4, which somewhat diagrammatically illustrates the prior art devices. In FIG. 4 there are seen a plurality of rails R. Rails R support a mobile carriage which is supported on a frame F. Frame F is rollingly supported on rails R by means of drive wheels W. Drive wheels W are powered by a motor M using a drive shaft S. As seen in FIG. 4, the wheels closest to motor M are imparted with greater turning motion, thus skewing the carriage as shown. The declining amount of forward movement of the wheels W as they are spaced away from motor M is caused by the fact that a substantial amount of torque needs to be applied by motor M through drive shaft S. This amount of torque causes rotational twisting of the drive shaft S resulting in a lesser amount of rotation of the end of the drive shaft opposite the motor M.

Figure 5:
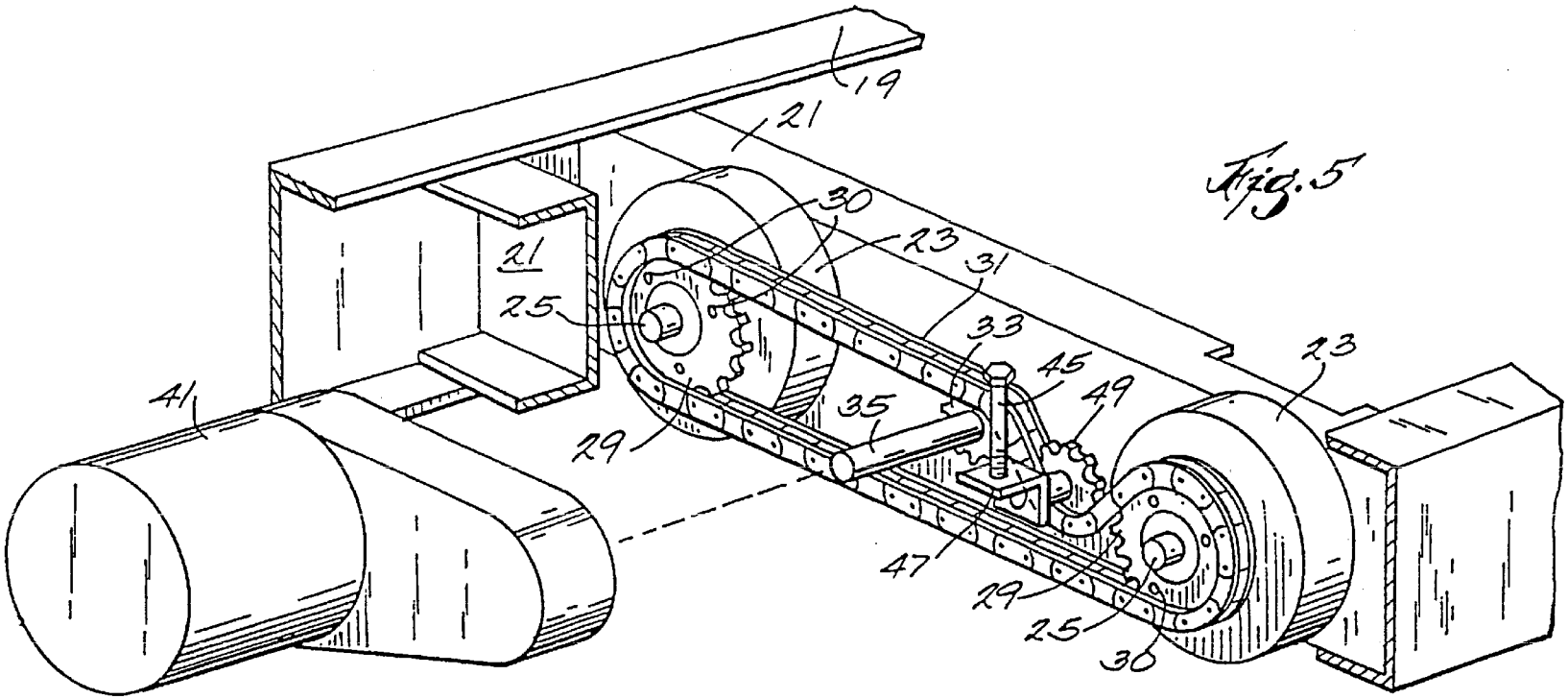
FIG. 5 is an exploded partially broken perspective view of an electrically powered drive mechanism according to the present invention.

To drive the carriage 10 along the rails 12*a* and 12*c*, the carriage frame 17 comprises a plurality, preferably two, pairs of drive wheels 23. Referring also to FIG. 5, the drive wheels 23 are rotatably mounted, usually by bearings, on respective axles 25. The axles 25 are supported between two channels 21 that span the frame longitudinal beams 19, or by end frame 20 and a channel 21. To each drive wheel is attached a sprocket 29, for example, by plug welds 30.

Trained over the sprockets 29 is a chain 31. The chain 31 is driven by a drive sprocket 33 which is fastened to a drive shaft 35 of a combination electrical motor and speed reducer 41. The motor and speed reducer combination 41 is mounted to the end frame member 20 by conventional fasteners. Drive sprocket 33 is of a substantially smaller effective diameter than driven sprockets 29. Thus, a substantially lesser torsional force is developed on drive shaft 35, relative to that of the prior art. To provide adjustability to the chain 31, adjusting screw 45 coacts between a flange 47 attached to end frame member 20 and an idler sprocket 49 which serves to adjust the tension on chain 31.

Actuation of the control 15 energizes the motor 41 to rotate the drive wheels 23 in synchronization and move the carriage 10 along the rails 12*a*, 12*b* and 12*c*. Appropriate controls are provided to start the carriage moving in either direction, and to stop the carriage at a desired location along the rails.

Figure 8:
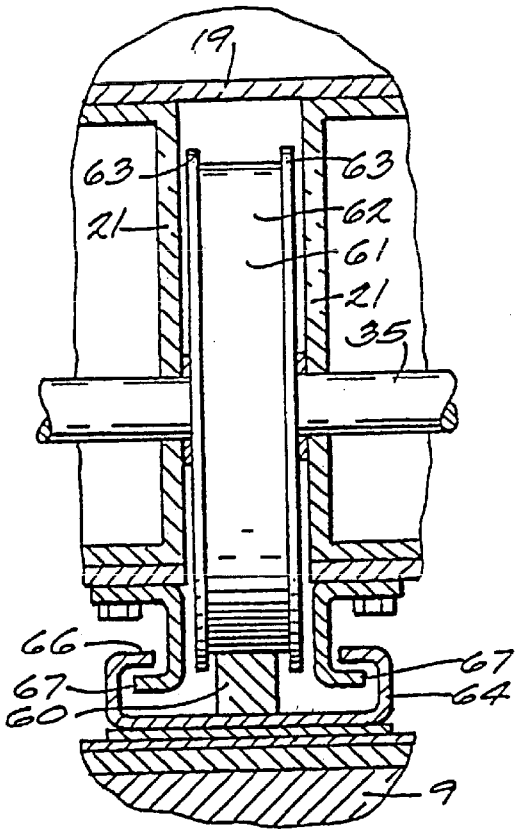
FIGS. 7 and 8 are fragmentary sectional Views similar to that of FIG. 6 showing alternate embodiments of the invention.
Figure 7:
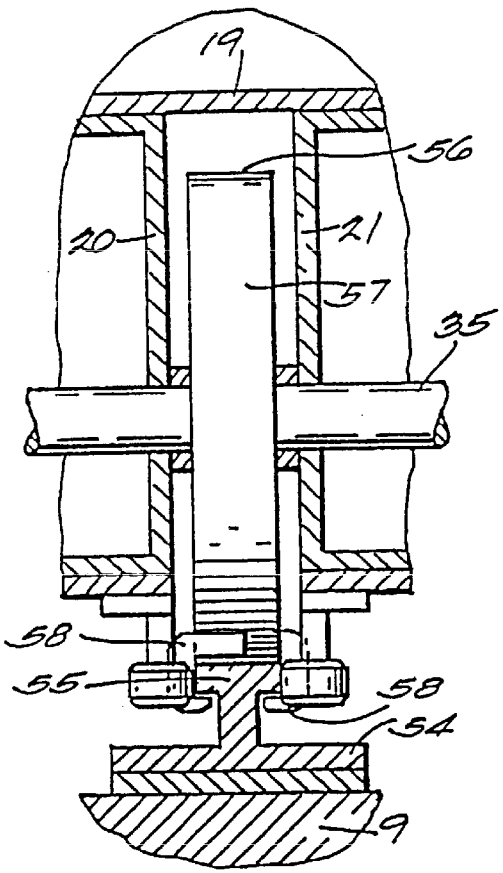
Figure 6:
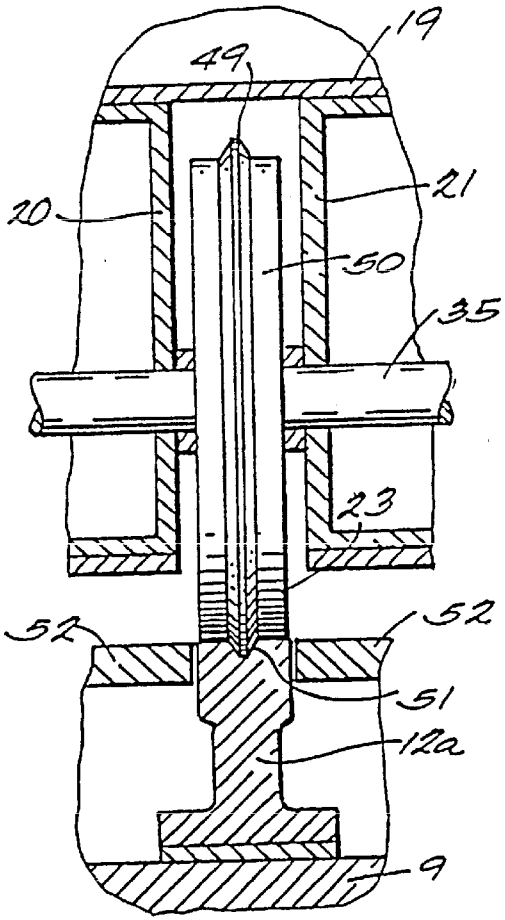
FIG. 6 is a fragmentary sectional view taken along Line 6—6 of FIG. 5.

FIGS. 6–8 show three alternate embodiments of structures provided to guide the carriage 10 along the rails 12*a*, 12*b* and 12*c*. In the embodiment of FIG. 6 each drive wheel 23 is formed with an annular flange 49 that extends concentrically from the wheel peripheral bearing surface 50. The drive wheel flanges 49 interfit within grooves 51 formed in the top surface of the rail 12*a*. In FIG. 6, reference numeral 52 represents decorative or safety floor panels placed between the rails, as is known in the art.

Turning to FIG. 7, an alternative version of a wheel and rail configuration usable in conjunction with the present invention is illustrated. In FIG. 7 there is seen an alternative form of supporting rail 54 which has a T-shaped upper supporting surface 55. A wheel 56 having a flat outer perimeter 57 supports the carriage 19 for rolling movement along rail 55. In order to prevent tipping of the carriage, it is preferred that clips 58 be attached as illustrated to cross frame members 20 and 21. It will be noted that the clips 58, which engage the upper T-shaped portion of rail 54, thus effectively prevent tipping of the carriage.

A still further embodiment of a wheel and rail configuration is illustrated in FIG. 8. In FIG. 8 an alternative rail 60 is of a square or rectangular cross-section. Rail 60 rollingly supports wheels 61 which are provided with a central flat surface 62 and side flanges 63 along each side thereof which extend outwardly from each side of the flat supporting surface 62 which rides along rail 60. Flanges 63 thus effectively keep the wheel 61 rolling along rail 60 as in the case of the flange 49 in the embodiment of FIG. 6. In order to provide an anti-tip mechanism for the version shown in FIG. 8, a generally C-shaped channel 64 is provided under rail 60. Inwardly extending ends 66 of channel 64 house downwardly extending clips 67 which, as shown, are affixed to cross frame members 21. Thus, tipping of the carriage supported on frame 19 is effectively prevented.

Figure 3:
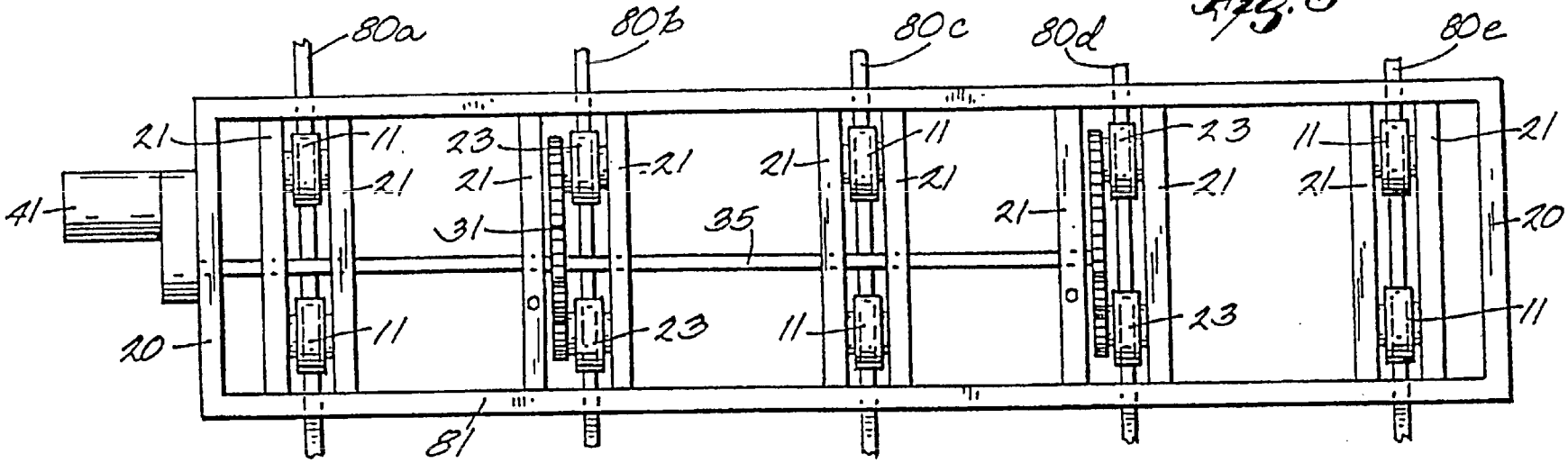
FIG. 3 a cross sectional view of another embodiment of the invention taken along lines 2—2 of FIG. 1 and rotated 90° counterclockwise.

Referring to FIG. 3, an alternate embodiment of an electrically powered mobile carriage is illustrated. In this embodiment five rails 80*a*–80*e* support a carriage frame 81. Non-powered supporting wheels 11 rollingly support the carriage 81 for movement along the associated rails 80*a*, 80*c* and 80*e*. Driven, synchronously powered pairs of wheels 23 are provided on at least two of the rails, in the illustrated embodiment, rails 80*b* and 80*d*. These wheels are driven by drive shaft 35 which is powered by motor/speed reducer 41. The remaining components of the design of FIG. 3, including the drive wheels 23 and sprockets 29, etc., are the same as for the design described previously.

A manually powered mobile carriage, the specific details of which are described in my above-noted issued '351 patent, may also be used as an alternate construction.

Thus, it is apparent that there has been provided, in accordance with the invention, mobile carriage that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A carriage for a mobile storage system, comprising:

a frame;

one or more storage members mounted to the frame;

a plurality of mobile supports interconnected with the frame, including first and second end mobile supports and a series of intermediate mobile supports located between the first and second end mobile supports; and a drive arrangement, comprising a power source, a drive shaft driven by the power source, and a pair of drive units arranged symmetrically relative to a center of the frame and drivingly interconnected with the drive shaft, wherein each drive unit is engaged with one of the intermediate mobile supports inwardly of one of the first and second end mobile supports;

wherein each drive unit comprises a pair of rollers, an input drive sprocket connected to the drive shaft, a driven sprocket interconnected with each roller, and a drive chain, wherein the drive chain includes a first section that extends in a first direction from the input drive sprocket toward a first one of the driven sprockets for engagement with the first driven sprocket, and a second section that extends in a second direction opposite the first direction from the input drive sprocket toward a second one of the driven sprockets for engagement with the second drive sprocket.

2. The carriage of claim 1, wherein the driven sprockets are in alignment with each other and wherein the first and second sections of the drive chain are generally coplanar and are formed of a single length of chain engaged with the input drive sprocket and with both of the driven sprockets.

3. The carriage of claim 2, further comprising a tensioning arrangement interconnected with one of the sections of the drive chain for maintaining tension in the fi and second sections of the drive chain.

4. The carriage of claim 1, wherein the pair of rollers are rotatably mounted to a support member associated with the frame, and wherein the pair of rollers are located outwardly of a laterally facing side defined by the support member.

5. The carriage of claim 4, wherein the driven sprockets are in alignment with each other and wherein the first and second sections of the drive chain are generally coplanar and are formed of a single length of chain engaged with the input drive sprocket and with both of the driven sprockets.

6. The carriage of claim 1, wherein the input drive sprocket defines a first diameter and wherein the driven sprockets each define a second diameter greater than the diameter.

7. A carriage for a mobile storage system, comprising:

a frame defining a center;

one or more storage members mounted to the frame;

a plurality of mobile supports interconnected with the frame; and a drive arrangement, comprising a power source, a drive shaft driven by the power source, and a pair of drive units drivingly interconnected with the drive shaft, wherein the drive units are located one on either side of the center of the frame, and wherein the drive units are arranged symmetrically relative to the center of the frame;

wherein each drive unit comprises a pair of rollers, an input drive sprocket connected to the drive shaft, a driven sprocket interconnected with each roller, and a drive chain, wherein the drive chain includes a first section that extends in a first direction from the input drive sprocket toward a first one of the driven sprockets for engagement with the first driven sprocket, and a second section that extends in a second direction opposite the first direction from the input drive sprocket toward a second one of the driven sprockets for engagement with the second drive sprocket.

8. The carriage of claim 7, wherein the driven sprockets are in alignment with each other and wherein the first and second sections of the drive chain are generally coplanar and are formed of a single length of chain engaged with the input drive sprocket and with both of the driven sprockets.

9. The carriage of claim 8, further comprising a tensioning arrangement interconnected with one of the sections of the drive chain for maintaining tension in the fist and second sections of the drive chain.

10. The carriage of claim 9, wherein the pair of rollers are rotatably mounted to a support member associated with the frame, and wherein the pair of rollers are located outwardly of a laterally facing side defined by the support member.

11. The carriage of claim 1, wherein the pair of rollers are rotatably mounted to a support member associated with the frame, and wherein the pair of rollers are located outwardly of a laterally facing side defined by the support member.

12. The carriage of claim 7, wherein the input drive sprocket defines a first diameter and wherein the driven sprockets each define a second diameter greater first diameter.

13. A carriage for a mobile storage system, comprising:

a frame defining a center;

one or more storage members mounted to the frame;

a plurality of mobile supports interconnected with the frame; and a drive arrangement, comprising a power source, a drive shaft driven by the power source, and a pair of drive units drivingly interconnected with the drive shaft, wherein the drive units are located one on either side of the center of the frame;

wherein each drive unit comprises first and second spaced apart rollers, input drive sprocket means located between the first and second rollers and interconnected with the drive shaft for providing input rotary power, first and second driven sprockets interconnected with the first and second rollers, respectively, and drive chain means engaged with the input drive sprocket means and with the first and second driven sprockets for driving the first and second driven sprockets, and thereby the first and second rollers, in response to rotation of the drive shaft.

14. The carriage of claim 13, wherein the drive units are arranged symmetrically relative to the center of the frame, and wherein the drive chain means comprises a first drive chain section and a second drive chain section that extend in opposite directions relative to the input drive sprocket means for engagement with the first and second drive sprockets, respectively.

15. The carriage of claim 14, wherein the fist and second driven sprockets are in alignment with each other, and wherein the first and second sections of the drive chain are generally coplanar and are formed of a single length of chain engaged with the input drive sprocket means and with both the first and second driven sprockets.

16. The carriage of claim 15, further comprising a tensioning arrangement interconnected with one of the first and second sections of the drive chain for maintaining tension the drive chain.

17. The carriage of claim 13, wherein the first and second rollers are rotatably mounted to a support member associated with the frame, and wherein the first and second rollers are located outwardly of a laterally facing side defined by the support member.

18. The carriage of claim 17, wherein the first and second driven sprockets are in alignment with each other and wherein the first and second sections of the drive chain are generally coplanar and are formed of a single length of chain engaged with the input drive sprocket means and with both the first and second driven sprockets.

19. The carriage of claim 13, wherein the input drive sprocket means comprises a drive sprocket defining a first diameter and wherein the first and second sprockets each define a second diameter greater than the first diameter.

20. A carriage for a mobile storage system, comprising:

a frame defining a center;

one or more storage members mounted to the frame;

a plurality of mobile supports interconnected with the frame; and a drive arrangement, comprising a power source, a drive shaft driven by the power source, and a pair of drive units drivingly interconnected with the drive shaft, wherein the drive units are located one on either side of the center of the frame;

wherein each drive unit comprises first and second spaced apart rollers and first and second driven members interconnected with the first and second rollers, respectively, a rotary power input arrangement interconnected with the drive shaft and located between the first and second driven members, and a flexible drive arrangement engaged with the rotary power input arrangement and with the first and second driven members for driving the first and second driven members, and thereby the first and second rollers, in response to rotation of the drive shaft.

21. The carriage of claim 20, wherein each of the first and second driven members comprises a driven sprocket and wherein the flexible drive arrangement comprises a drive chain arrangement.

22. The carriage of claim 21, wherein the drive chain arrangement includes a fir t drive chain section extending from the rotary power input arrangement in a first direction for engagement with the first driven sprocket and a second drive chain section extending from the rotary power input arrangement in a second direction for engagement with the second driven sprocket.

23. The carriage of claim 21, wherein the rotary power input arrangement comprises an input drive sprocket interconnected with the drive shaft.

24. The carriage of claim 23, wherein the first and second driven sprockets are in alignment with each other, and wherein the first and second drive chain sections are generally coplanar and are formed of a single length of chain engaged with the input drive sprocket and with both the first and second driven sprockets.

25. The mobile carriage of claim 24, further comprising a tensioning arrangement interconnected with one of the first and second sections of the drive chain for maintaining tension in the drive chain.

26. The mobile carriage of claim 24, wherein the first and second rollers are rotatably mounted to a support member associated with the frame, and wherein the first and second rollers are located outwardly of a laterally facing side defined by the support member.

27. The mobile carriage of claim 26, wherein the first and second driven sprockets are in alignment with each other and wherein the first and second drive chain sections are generally coplanar and are formed of a single length of chain engaged with the input drive sprocket and with both the first and second driven sprockets.

28. The mobile carriage of claim 20, wherein the input drive member comprises a drive sprocket defining a first diameter and wherein the first and second driven members comprise first and second drive sprockets, respectively, each of which defines a second diameter greater than the first diameter.

* * * * *

UNITED STATES PATENT AND TRADEMARK OFFICE

CERTIFICATE OF CORRECTION

PATENT NO. : 6,644,213 B2
DATED : November 11, 2003
INVENTOR(S) : James C. Muth

It is certified that error appears in the above-identified patent and that said Letters Patent is hereby corrected as shown below:

Column 5,
Line 35, delete "fi" and substitute therefore -- first --;

Column 6,
Line 16, delete "9" and substitute therefore -- 7 --;
Lines 20-23, delete claim 11 in its entirety, and substitute therefore
-- The carriage of claim 10, wherein the drive sprockets are in alignment with each other and wherein the first and second sections of the drive chain are generally coplanar and are formed of a single length of chain engaged with the input drive sprocket and with both of the driven sprockets. --;
Line 26, after "greater" insert -- than the --;
Line 54, delete "drive" and substitute therefore -- driven --;
Line 56, delete "fist" and substitute therefore -- first --;
Line 64, after "tension" insert -- in --;

Column 7,
Line 12, after "second" insert -- driven --;

Column 8,
Line 2, delete "fir t" and substitute therefore -- first --.

Signed and Sealed this

Seventeenth Day of February, 2004

JON W. DUDAS
*Acting Director of the United States Patent and Trademark Office*